US008839722B2

(12) United States Patent
Prockat et al.

(10) Patent No.: US 8,839,722 B2
(45) Date of Patent: Sep. 23, 2014

(54) LIGHTWEIGHT COMPOUND CAB STRUCTURE FOR A RAIL VEHICLE

(75) Inventors: Jan Prockat, Berlin (DE); Conor O'Neill, New-castle upon Tyne (GB); Joseph Carruthers, Dronfield (GB); Mark Robinson, Morpeth (GB)

(73) Assignee: Bombardier Transportation GmbH, Berlin (DE)

( * ) Notice: Subject to any disclaimer, the term of this patent is extended or adjusted under 35 U.S.C. 154(b) by 0 days.

(21) Appl. No.: 13/824,669

(22) PCT Filed: Sep. 19, 2011

(86) PCT No.: PCT/EP2011/066252

§ 371 (c)(1), (2), (4) Date: Oct. 11, 2013

(87) PCT Pub. No.: WO2012/038383

PCT Pub. Date: Mar. 29, 2012

(65) Prior Publication Data

US 2014/0033949 A1 Feb. 6, 2014

(30) Foreign Application Priority Data

Sep. 20, 2010 (WO) ..... PCT/IB2010/002365

(51) Int. Cl.

| | |
|---|---|
| ***B61D 15/06*** | (2006.01) |
| ***B61C 17/04*** | (2006.01) |
| ***B61D 17/06*** | (2006.01) |
| ***B61D 17/04*** | (2006.01) |

(52) U.S. Cl.

CPC ..... *B61C 17/04* (2013.01); *B61D 17/06* (2013.01); *B61D 17/041* (2013.01)

USPC ..... 105/392.5; 213/220

(58) Field of Classification Search

CPC .. B61D 17/041; B61D 17/043; B61D 17/045; B61D 17/04; B61D 17/06; B61D 15/06

USPC ..... 105/392.5, 394, 396; 213/1 A, 220, 221, 213/222

See application file for complete search history.

(56) References Cited

U.S. PATENT DOCUMENTS 5,669,999 A * 9/1997 Anderegg et al. ..... 156/173
6,158,356 A * 12/2000 Hachet et al. ..... 105/392.5

(Continued)

FOREIGN PATENT DOCUMENTS

DE 196 49 526 A 6/1998
DE 298 07 576 U 8/1998

(Continued)

OTHER PUBLICATIONS

"Les Nouvelles Motrices des Chemins de Fer Federaux 100% Composites", *Composites. Plastiques Renforces Fibres de Verre Textile, Centre Doc. Verre Textile Plus*. Re. Paris, Fr., vol. 33, No. 5, Sep. 1, 1993, p. 66, document also appears in English.

(Continued)

*Primary Examiner* — Jason C Smith

(74) *Attorney, Agent, or Firm* — Frommer Lawrence & Haug LLP; Ronald R Santucci

(57) ABSTRACT

An integrated self-supporting and deformation-resistant modular driver's cabin structure for mounting to the front end of a rail vehicle body and for providing a driver space and a windshield opening, is composed of a composite sandwich structure with a single, common, continuous outer skin layer, a single, common, continuous inner skin layer and an internal structure wholly covered with and bonded to the inner and outer skin layers, the internal structure comprising a plurality of core elements. The driver's cabin structure comprises at least: side pillars each having a lower end and an upper end, and an undercarriage structure at the lower end of each of the side pillars. The fiber-reinforced sandwich located in the side pillars is provided with several layers of fibers oriented to provide a high bending stiffness. The fiber-reinforced sandwich of the undercarriage structure is such to transfer static and crash loads without flexural buckling.

26 Claims, 4 Drawing Sheets

(56) References Cited

U.S. PATENT DOCUMENTS

| | | | | |
|---|---|---|---|---|
| 6,167,815 | B1 * | 1/2001 | Werner et al. | 105/392.5 |
| 6,245,408 | B1 * | 6/2001 | Bitzer | 428/118 |
| 6,431,083 | B1 * | 8/2002 | Carstensen et al. | 105/238.1 |
| 6,561,105 | B2 * | 5/2003 | Godin et al. | 105/396 |
| 6,951,176 | B2 * | 10/2005 | Taguchi | 105/392.5 |
| 8,141,497 | B2 * | 3/2012 | Kwon et al. | 105/392.5 |
| 8,225,722 | B2 * | 7/2012 | Graf et al. | 105/392.5 |
| 8,261,672 | B2 * | 9/2012 | Heinisch et al. | 105/392.5 |
| 8,607,713 | B2 * | 12/2013 | Scholz | 105/413 |
| 2004/0159263 | A1 * | 8/2004 | Yamamoto et al. | 105/392.5 |
| 2005/0186415 | A1 * | 8/2005 | McCormick et al. | 428/336 |
| 2010/0064931 | A1 * | 3/2010 | Heinisch et al. | 105/392.5 |
| 2010/0218701 | A1 * | 9/2010 | Graf et al. | 105/392.5 |
| 2011/0011302 | A1 * | 1/2011 | Mayer | 105/392.5 |
| 2012/0325108 | A1 * | 12/2012 | Graf et al. | 105/392.5 |
| 2013/0233200 | A1 * | 9/2013 | Taguchi et al. | 105/392.5 |
| 2013/0239847 | A1 * | 9/2013 | Taguchi et al. | 105/392.5 |
| 2014/0020596 | A1 * | 1/2014 | Graf et al. | 105/392.5 |
| 2014/0033949 | A1 * | 2/2014 | Prockat et al. | 105/392.5 |

FOREIGN PATENT DOCUMENTS

| | | | |
|---|---|---|---|
| DE | 10 2006 044 397 | A | 3/2008 |
| EP | 0 533 582 | A | 3/1993 |
| WO | WO 2005/085032 | A | 9/2005 |
| WO | WO 2010/029188 | A | 3/2010 |

OTHER PUBLICATIONS

Notification of Transmittal of the International Search Report and the Written Opinion of the International Searching Authority, or the Declaration, issued by the EPO, acting as the searching authority, for priority application PCT/IB2010/002365, dated Jul. 11, 2011.

* cited by examiner

LIGHTWEIGHT COMPOUND CAB STRUCTURE FOR A RAIL VEHICLE

This application is a 371 of PCT/EP2011/066252 filed on Sep. 19, 2011, published on Mar. 29, 2012 under publication number WO 2012/038383 A, which claims priority benefits to International Patent Application PCT/IB2010/002365 filed Sep. 20, 2010, the entire disclosure of which is incorporated herein by reference.

TECHNICAL FIELD OF THE INVENTION

The invention relates to lightweight structures for the driver's cabin of a rail vehicle.

BACKGROUND ART

The rail industry needs lightweight materials and structures for rail vehicles in order to meet the challenges it faces in terms of capacity increases and energy efficiency. Lightweighting also brings reductions in vehicle operating costs. Furthermore, lighter vehicles cause less damage to track, thereby reducing infrastructure renewal costs.

A railway vehicle defining a longitudinal direction and comprising: a central section and a modular vehicle cabin is disclosed in WO 05/085032. The vehicle cabin comprising a collapsible front section that undergoes controlled collapse in case of collision and at least one rigid section located between the front section and the central section. The front section has a lower resistance to deformation than the rigid section. At least one dedicated repair interface is provided for removably fixing the vehicle cabin to the central section. The dedicated repair interface comprises a thick sheet metal plate extending in a vertical plane perpendicular to the longitudinal direction over the whole cross-section of the vehicle body with or without opening for allowing access from the vehicle cabin to the central section of the vehicle. The vehicle cabin has a self-supporting and deformation-resistant modular structure providing a driver space and a windshield opening. This cabin structure is composed of frame members made of steel and comprises side pillars each having a lower end and an upper end, and an undercarriage structure at the lower end of each of the side pillars. Such rail vehicle cab structures based on welded steel assemblies including an additional composite cover can weigh more than 1 tonne each. With two cabs per train-set, this represents a significant weight saving opportunity. Furthermore, current cab designs tend to be very complex, high part count assemblies with fragmented material usage. This is because they must meet a wide range of demands including proof loadings, crashworthiness, missile protection, aerodynamics and insulation. Assembly costs are high, and there is little in the way of functional integration.

A rail vehicle provided with a head module made of a fibre composite material is known from U.S. Pat. No. 6,431,083. The undercarriage of the vehicle supports the coach body of the vehicle and extends beyond the coach body to support the head module, which is joined to the undercarriage via a nearly horizontal interface. The head module consists of at least one head module front wall, two head module side walls, and one head module roof, which can be produced jointly as one unit. While the assembly of the head module on the undercarriage is simple and allows a certain degree of modularity in the design of the vehicle, its replacement in case of a front collision is much more difficult, since the undercarriage is not part of the head module and is likely to be damaged during the crash. Moreover, only partial weight reduction is achieved since the undercarriage is a conventional cast or welded metal structure. Last but not least, the unitary structure of the head module is a uniform sandwich structure composed of a core and laminated walls, which are not locally optimised for selectively dissipating, i.e. absorbing, the impact energy that occurs during a crash while preserving a survival space for the driver. A similar design with similar same limitations is disclosed in EP 0 533 582, which relates to a modular driver's cabin to be attached on the undercarriage of a rail vehicle. The walls of the cabin constitute a one-piece assembly including a front wall a bottom, a roof, a rear wall and two sidewalls. The wall of the cab and the framework of the cab console constitute a one-piece composite material assembly. The integration of the console framework stiffens the cab.

A vehicle front end module comprising both an undercarriage structure and wholly composed of structural elements made from fibre composite or fibre composite sandwich material is disclosed in US 2010/0064931. By using different composite/fibre composite sandwich structures for the individual areas of the vehicle front end module structure, it becomes conceivable to provide both a substantially deformation-resistant, self-supporting structure composed of first structural elements made of fibre-reinforced polymer (FRP), which does not collapse upon collision thereby providing a survival space for the driver, and an impact absorbing structure located in front of the deformation-resistant structure and composed of second structural elements designed to at least partly absorb the impact energy. The highly rigid first individual structural elements building the deformation-resistant, self-supporting structure include A pillars, side struts, a railing element to structurally connect the two A pillars and the two side struts, and an undercarriage structure, which have to be connected together, preferably in a material fit and more specifically an adhesive bond. The number of individual parts of the front end assembly is therefore high, hence a high manufacturing cost. Due to dimensional tolerances and manufacturing limits, the material fit between the individual parts may be imprecise. Moreover, the interface between individual structural elements is less than optimal in terms of mechanical behaviour, reproducibility, additional weight and thermal and acoustic isolation.

SUMMARY OF THE INVENTION

The foregoing shortcomings of the prior art are addressed by the present invention. According to one aspect of the invention, there is provided an integrated self-supporting and deformation-resistant modular driver's cabin structure for mounting to the front end of a rail vehicle body, the driver's cabin structure having a front end and a longitudinal direction, the driver's cabin structure providing a driver space and a windshield opening, the driver's cabin structure consisting of a composite sandwich structure with a single, common, continuous outer skin layer, a single, common, continuous inner skin layer and an internal structure wholly covered with and bonded to the inner and outer skin layers, the internal structure comprising a plurality of core elements, the composite sandwich structure comprising a unitary matrix for bonding the internal structure, the inner skin layer and outer skin layer, parts of the outer skin layer being directly exposed to the outside, parts of the inner skin layer being directly used as inner wall for the driver's cabin, the driver's cabin structure comprising at least:

- side pillars each having a lower end and an upper end, comprising a fibre-reinforced sandwich, and
- a reactor structure located towards, and integrated with the lower end of each of the side pillars, the reactor structure being reinforced such as to transfer static and crash loads to the main body structure of the rail vehicle and including a central cavity open towards the front end of the driver's cabin to accommodate a coupling element for the rail vehicle.

Thanks to continuous inner and outer skin layers, no boundary effects are experienced within the structure, which is a true monocoque structure.

While the matrix material may not be exactly the same at different locations of the driver's cabin structure, its modifications, if any, are substantially continuous within the structure. It may in particular be a polymer matrix, in particular a thermoset or thermoplastic matrix.

The inner and outer shell layers are preferably made of quasi-isotropic fibre composite material, preferably using glass, carbon, aramid or other fibres as a reinforcement material embedded in a matrix as described above. The reinforcing fibres may have a variety of forms including discrete fibres (long or short, oriented or random) or textiles (woven, braided, stitched, etc.). In particular, the inner and outer skin layers of the composite sandwich structure may include fibre-reinforced polymers or FRPs, like carbonfibre-reinforced polymer (CFRP), glass fibre-reinforced polymer (GFRP) or/and others.

The internal structure may consist of a sandwich construction produced from glass fibre reinforced polymer (GFRP) composite layers and core elements made of polymer or aluminium foam, balsa or other lightweight wood or any kind of honeycomb core material, including aluminium honeycomb, aramid paper-based honeycomb, other paper-based honeycomb, or polymer-based honeycomb.

Advantageously, the sandwich structure is significantly reinforced in the side pillars and reactor in order to provide sufficient stiffness and strength for resisting energy absorber collapse forces without permanent deformation or damage.

The composite sandwich structure at the side pillars is preferably provided with several layers of fibres oriented to provide the desired high bending stiffness. The pillar may include vertical columns of foam sandwiched between continuous vertical layers of GFRP to produce a multi-layer sandwich construction.

The composite sandwich structure of the reactor advantageously comprises fibres oriented such as to transfer static and crash loads to the main body structure of the rail vehicle without flexural buckling. It may consist of an array of bonded foam cores wrapped in glass fibre reinforced polymer to produce a macro-cellular structure to transfer loads without flexural buckling.

According to an embodiment, the driver's cabin structure further comprises reinforcing roof beams each at the upper end of one of the side pillars. Advantageously, the composite sandwich structure comprises an orientated fibre lay-up in the roof beams to provide an anisotropic strength with higher strength in the longitudinal direction of the roof beams. Alternatively, the fibre lay-up may provide an isotropic strength performance. The roof beams may further provide local reinforcement points for fixing the cab to the main car body structure. The roof structure may further comprise a roof panel extending between the roof beams and connecting the side pillars with one another.

According to a preferred embodiment, the driver's cabin structure provides a side door opening for accessing the driver space and/or a side window opening.

According to another aspect of the invention, there is provided a modular front end structure for a rail vehicle, including:

an integrated self-supporting and deformation-resistant driver's cabin structure, as described hereinbefore, a distributed upper energy absorber means consisting of a crossbeam extending continuously from one of the side pillars to the other.

The modular front end structure will be integrated with an external shell, provided with an opening for a windshield and a possible door or a possible side window, as well as with a possible driver's control stand, to form a modular front end.

Preferably, the upper energy absorber means comprises a collapsible structure extending from one of the side pillars to the other such as to provide an energy absorption capability.

The crossbeam may be composed of a sandwich of one or more sheet materials and energy absorbing core materials. In particular, it may be formed as a multi-layer aluminium honeycomb sandwich. The crossbeam may comprise a metallic core (e.g. aluminium honeycomb material) with metal sheet facings (e.g. steel or aluminium). The thicknesses of the metallic core and the metal sheet facings are chosen according to the crash requirements. According to one preferred embodiment, the crossbeam acts as both a lateral stiffening element and an energy-absorbing element. The beam may also provide a contribution to the missile protection of the driver. The crossbeam is separate from the monocoque structure of the integrated self-supporting driver's cabin structure, to allow for easy removal and replacement after an impact.

The modular front end structure may be provided with second energy absorber elements. The second energy absorber elements are preferably located substantially at buffer height or at the height of the reactor structure or close to this height. Preferably, the second energy absorbers are attached to the lower side pillars directly below the cross beam. In case of frontal impact, the second energy absorber will collapse and dissipate energy, while the reactor structure of the modular front end structure will withstand the longitudinal forces and transfer them to the sole bars of the main body structure of the rail vehicle. The secondary energy absorbers provide the primary interface with the colliding train.

The modular front end structure further comprises an interface for joining to the front end of the main body structure of a rail vehicle.

According to another aspect of the invention, there is provided an integrated self-supporting and deformation-resistant modular driver's cabin structure for mounting to the front end of a rail vehicle body, the driver's cabin structure having a front end and a longitudinal direction, the driver's cabin structure providing a driver space and a windshield opening, the driver's cabin structure including two side parts, each side part consisting of a composite sandwich structure with a single, common, continuous outer skin layer, a single, common, continuous inner skin layer and an internal structure covered with and bonded to the inner and outer skin layers, the internal structure comprising a plurality of core elements, the composite sandwich structure comprising a unitary matrix for bonding the internal structure, the inner skin layer and outer skin layer, parts of the outer skin layer being directly exposed to the outside, parts of the inner skin layer being directly used as inner wall for the driver's cabin, each side part comprising at least: one side pillar having a lower end and an upper end, comprising a fibre-reinforced sandwich, and a reactor element extending from the lower end of each of the side pillar in the longitudinal direction towards the rear end of the driver's cabin structure, the reactor element being reinforced such as to transfer static and crash loads to the main body structure of the rail vehicle, the driver's cabin structure being provided with a central cavity between the reactor elements of the two side parts, the central cavity being open towards the front end of the driver's cabin to accommodate a coupling element for the rail vehicle.

The fibre-reinforced sandwich at the side pillars is preferably reinforced such as to provide a high bending stiffness. The reactor elements are preferably reinforced so as to transfer static and crash loads to the main body structure of the rail vehicle without flexural buckling.

Each side part forms an integral monocoque structure, the internal structure of which is preferably wholly covered by the outer and inner skin layers. As a variant, the end faces of the reactor elements are not covered.

The internal structure in the side pillar and in the reactor element comprises a plurality of core elements. Each core element is covered by a composite material. As a variant, the end faces of the core elements are not covered.

Each side part may further include a roof beam extending in the longitudinal direction from the upper end of the side pillar towards the rear end of the driver's cabin structure. In such a case, the single, common, continuous outer skin layer and single, common, continuous inner skin layer and an internal structure wholly covered with and bonded to the inner and outer skin layers.

The two side parts can be manufactured simultaneously in one mould also including a roof panel, which extends from one roof beam to the other to form a unitary structure. They can also, as a variant, be manufactured separately and assembled to one another at a later stage.

According to a further aspect of the invention, there is provided a process for manufacturing the integrated self-supporting and deformation-resistant driver's cabin structure for a modular cabin of a rail vehicle or the modular front end structure for a rail vehicle as described hereinbefore, wherein a unitary matrix material is introduced to skin layer reinforcement fibres and to core materials before or after the reinforcement fibres are placed into a mould cavity or onto a mould surface of a mould and the matrix material subsequently experiences a polymerisation or curing event to constitute the sandwich composite structure.

According to one embodiment, the fibres of the inner skin layer and/or outer skin layer and the core materials are placed in the mould cavity or on the mould surface before the unitary matrix material is introduced.

BRIEF DESCRIPTION OF THE DRAWINGS

Other advantages and features of the invention will become more clearly apparent from the following description of specific embodiments of the invention given as non-restrictive example only and represented in the accompanying drawings in which.

DETAILED DESCRIPTION OF VARIOUS EMBODIMENTS

Figure 1:
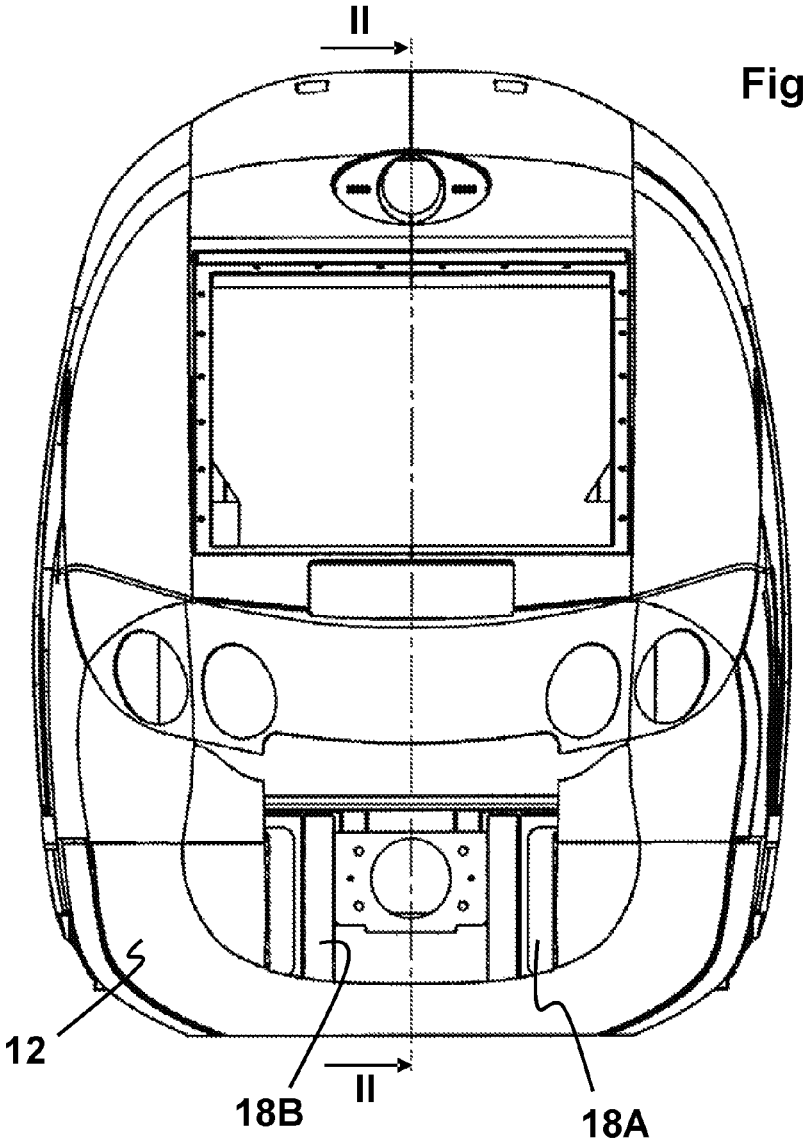
FIG. 1 is a front view of a modular front-end structure including a driver's cabin structure for a rail vehicle according to one embodiment of the invention.
Figure 2:
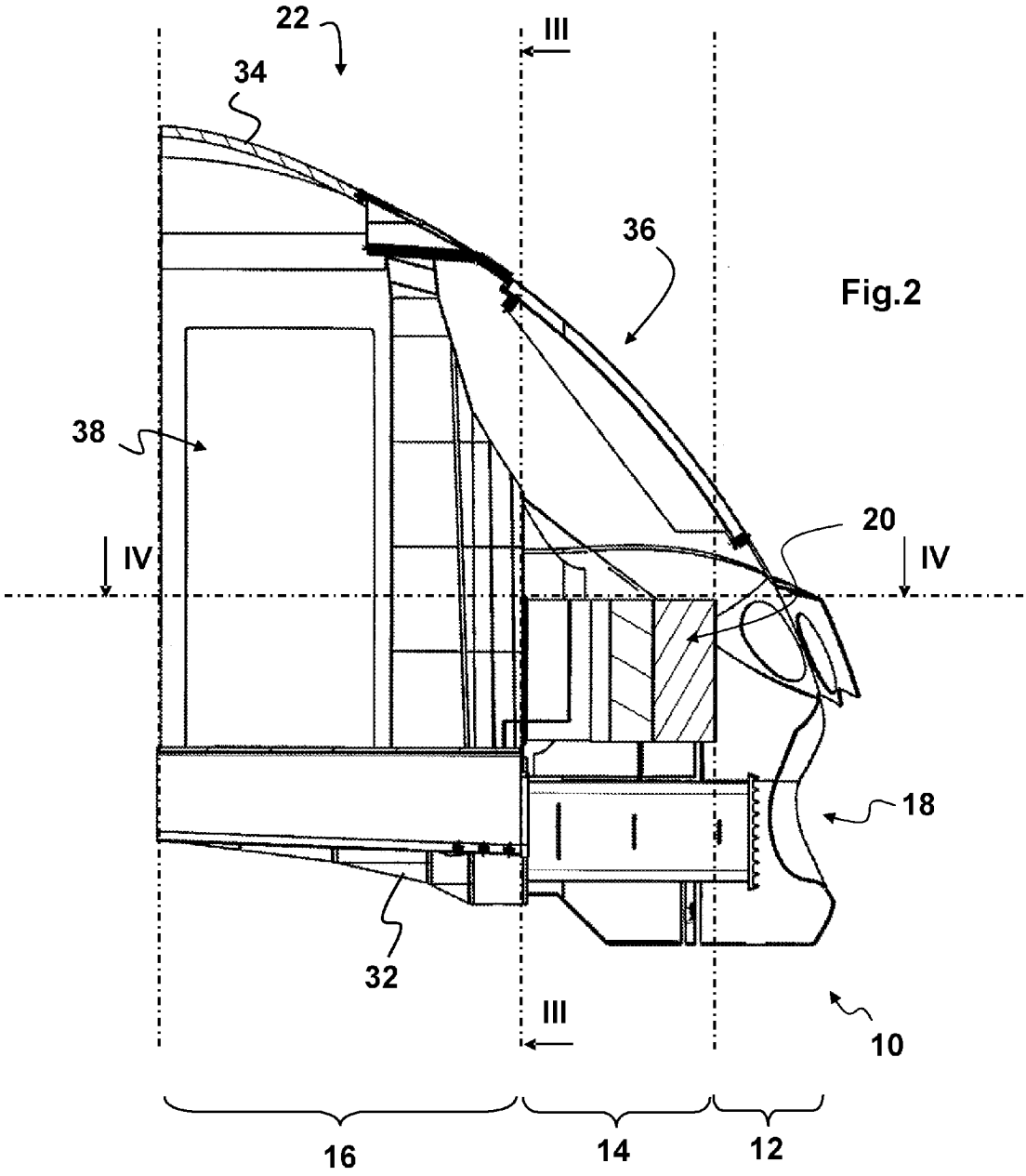
FIG. 2 is a longitudinal section through plane II-II of FIG. 1.
Figure 3:
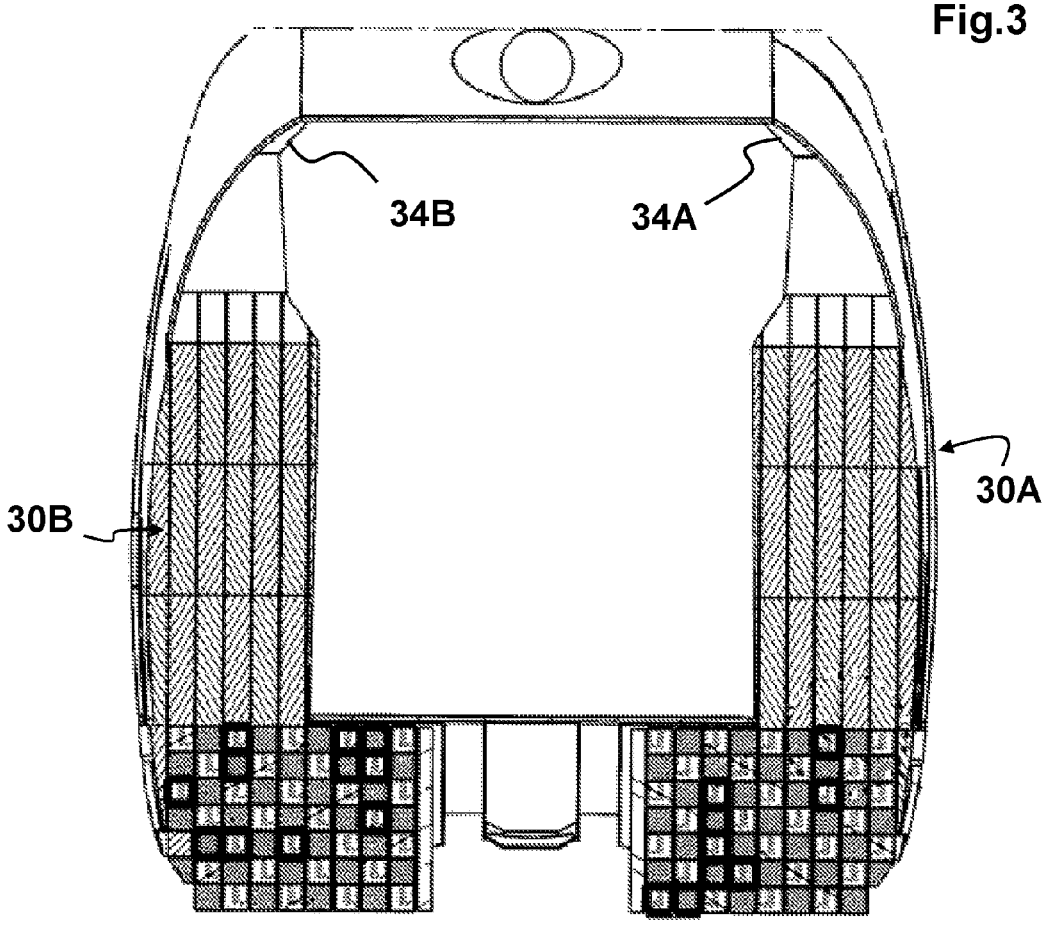
FIG. 3 is a cross-section through plane III-III of FIG. 2.

Referring to FIGS. 1 and 2, a modular front end structure 10 for a rail vehicle, consists of three modules, namely a lower strength primary crush zone 12 or "nose" located at the front end of the structure, a higher strength secondary crush zone 14, which is located behind the primary crush zone and contains the majority of the cab's energy absorption capability, and a reaction zone 16 which is able to resist the collapse loads of the two frontal crush zones 12, 14, whilst protecting the driver and ensuring that any forces are properly transferred to the main part of the coach body, which represents a hard zone providing a survival cell for the passengers.

The nose 12 is designed to be easily detached and reattached. This is to facilitate repair or replacement following minor collisions. The nose 12 is designed to contribute to the overall energy absorption capability of the cab. Energy absorbing materials and structures are suitably deployed within the available volumetric envelope of the nose.

The higher strength secondary crush zone 14 includes lower, buffer-level energy absorber means 18 and upper energy absorber means 20. The lower, buffer-level energy absorber means 18 are two interchangeable discrete energy absorbers 18A, 18B e.g. with an aluminium honeycomb sandwich construction which provides excellent performance levels in terms of constant and continuous absorbed energy during a crash or a more conventional welded-steel type.

Figure 4:
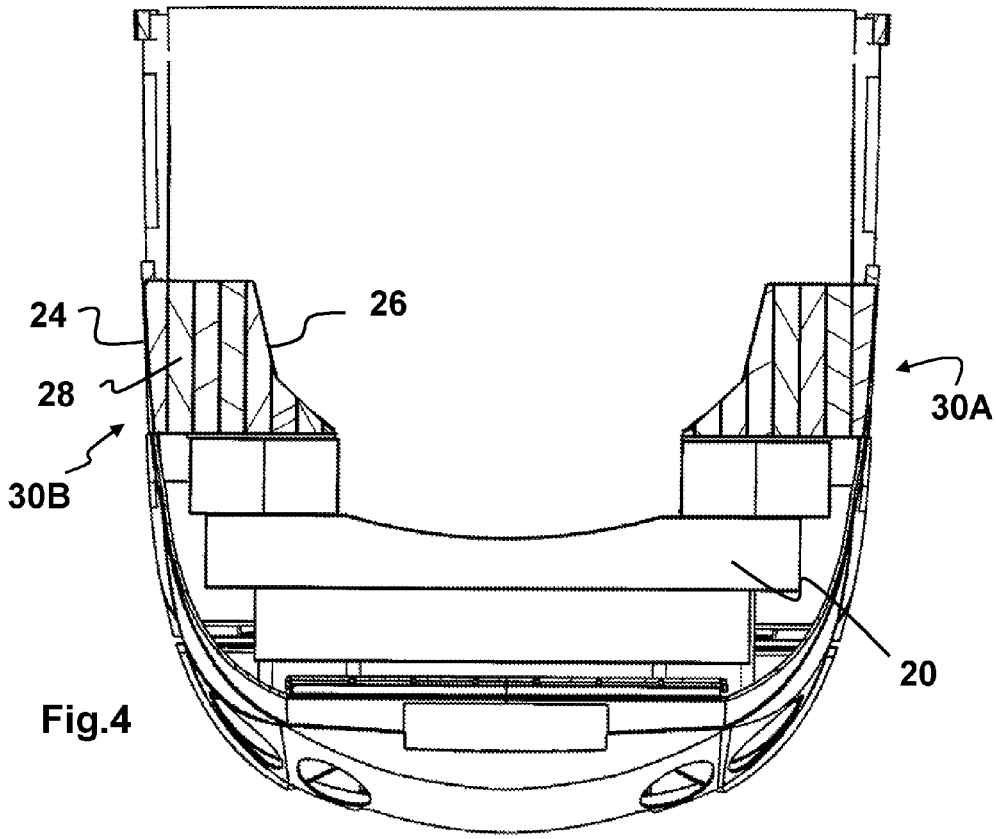
FIG. 4 a horizontal section through plane IV-IV of FIG. 2.

The upper energy absorber means 20 consists of a distributed energy absorbing zone, which runs across the width of the cab as illustrated in FIG. 4. The main function of the upper energy absorber means 20 is to resist the collision with a deformable obstacle. As the deformable obstacle provides a distributed load input to the cab, the use of a distributed energy absorbing zone, i.e. a zone that extends continuously from side to side of the front-end, is preferable to the use of discrete energy absorbing elements. The upper energy absorber means 20 can be formed as a multi-layer aluminium honeycomb sandwich. In addition to providing an energy absorption capability, the resulting sandwich crossbeam 20 also provides additional lateral rigidity to the cab, as well as enhanced missile protection coverage for the driver.

The reaction zone 16 forms an integrated self-supporting and deformation-resistant driver's cabin structure 22.

The driver's cabin structure 22 is composed of a sandwich composite structure with a single, common, continuous outer skin layer 24, a single, common, continuous inner skin layer 26 and an internal structure 28 wholly covered with and bonded to the inner and outer skin layers 24, 26.

The driver's cabin structure 22 comprises side pillars 30A, 30B, each having a lower end and an upper end, a reactor structure 32 at the lower end of each of the side pillars, and can also be integral with a roof structure 34 including roof beams 34A, 34B each at the upper end of one of the side pillars 30A, 30B and a roof panel extending from one roof beam to the other.

As severe collisions occur less frequently than minor collisions, there is no disassembly requirement for the interface between the secondary crush zone 14 and the reaction zone 16. Hence, while the upper energy absorbing means was described in connection with the secondary crush zone rather than with the reaction zone, due to its main function during a collision, it may structurally be integrally formed with the driver's cabin structure, and share continuous inner and outer layers with the side pillars and reactor structure. As the upper energy absorbing means extends from one of the side pillars to the other, it provides a crossbeam, which as stated before also provides additional lateral rigidity to the cab.

The internal structure of the driver's cabin structure 22 consists of a sandwich construction produced from glass fibre reinforced polymer (GFRP) composite layers and polymer foam. The sandwich is significantly reinforced in the pillar region 30A, 30B (where the upper energy absorber means attaches) and the reactor structure 32 (where the buffer level energy absorbers attach) in order to provide the necessary stiffness and strength for resisting the energy absorber collapse forces without permanent deformation or damage. The reactor structure 32 in the lower buffer regions consists of an array of bonded square-section foam cores wrapped in glass fibre reinforced polymer (GFRP) to produce a macro-cellular structure to transfer loads without flexural buckling. The pillar regions 30A, 30B, above the reactor structure 32, also consists of an assembly of GFRP and foam cores. Each vertical column of foam in the pillars 30A, 30B is sandwiched between continuous vertical layers of GFRP to produce a multi-layer sandwich construction to provide a high bending stiffness to the side pillars 30A, 30B.

The roof beams 34A, 34B comprise a composite sandwich construction made of optimised orientated layered fibres, providing an anisotropic strength with higher strength in a longitudinal direction of the roof beams, or made of composite material with isotropic strength performance.

A windshield opening 36 is provided between the side pillars 30A, 30B, roof structure 34 and crossbeam 20. A side door or window opening 38 is provided on each side of the driver's cabin structure 22, between the reactor structure 32, the corresponding side pillar 30A, 30B and the roof structure 34.

Figure 5:
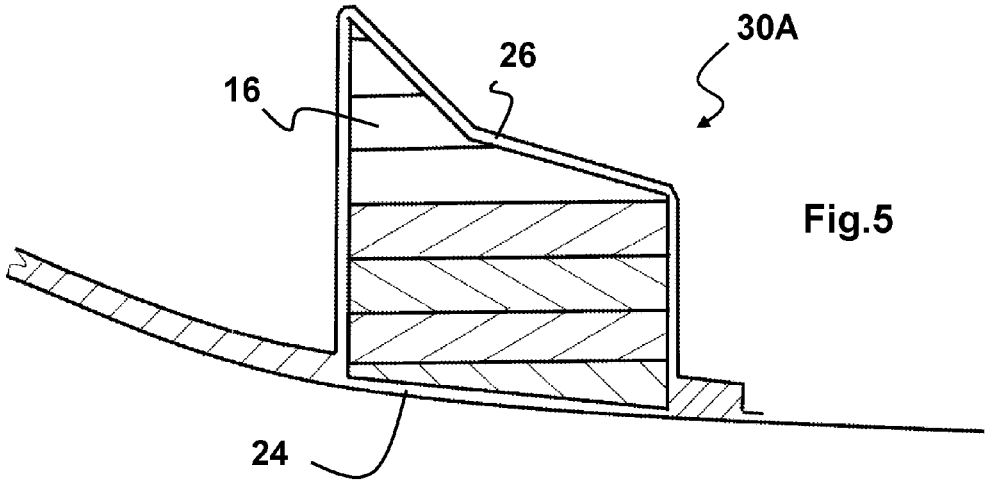
FIG. 5 is a detail from FIG. 4.

Some parts of the outer skin layer 26 may be directly exposed to the outside, i.e. without interposition of a shell as shown in FIG. 5, while other parts of the outer skin may be protected from the outside by an external shell, as e.g. in the nose region.

Similarly, parts of the inner skin layer 24 may be directly used as inner wall for the driver's cabin.

The driver's cabin structure as a whole provides a driver space, open towards the rear of the structure, i.e. towards the main part of the coach body to which the front-end structure is to be assembled.

The front-end structure is also provided with an interface for joining it to a front end of the main body structure of a rail vehicle.

During the manufacturing process of the driver's cab structure, a unitary matrix material is introduced to reinforcement fibres and core materials before or after the reinforcement fibres and core materials are placed into a mould cavity or onto a mould surface of a mould and the matrix material subsequently experiences curing to constitute the sandwich composite structure with a unitary matrix to which the inner skin layer and outer skin layer are also bonded.

While the invention has been described in connection with one example, variations are possible.

While a crossbeam is necessary for rigidifying the structure of the driver's cab, this crossbeam is not necessarily unitary with the first energy absorbing means. It is therefore possible to include e.g. a crossbeam integral with the structure of the driver's cabin structure, and separate energy absorbing means, e.g. discrete energy absorber attached to the crossbeam or a continuous energy absorbing element extending all the width of the driver's cabin.

The reactor structure of the integrated self-supporting and deformation-resistant modular driver's cabin structure may include a central cavity open towards the front end of the driver's cabin, to accommodate a coupling element for the rail vehicle. Preferably, the reactor structure includes at least two reactor elements extending in a longitudinal direction of the driver's cabin on each side of the central cavity. While the lateral, upper and lower faces of the reactor elements are covered with the skin layer, the end faces may not be covered. These two reactor elements are connected with one another through the side pillars and the roof structure.

The internal structure in the side pillars and in the reactor elements comprises a plurality of core elements. Each core element is covered by a composite material. As a variant, the end faces of the core elements are not covered.

Inner and outer skin layers may be united to form a shell completely encapsulating the internal structure.

What is claimed is:

1. An integrated self-supporting and deformation-resistant modular driver's cabin structure for mounting to the front end of a rail vehicle body, the driver's cabin structure having a front end and a longitudinal direction, the driver's cabin structure providing a driver space and a windshield opening, the driver's cabin structure consisting of a composite sandwich structure with a single, common, continuous outer skin layer, a single, common, continuous inner skin layer and an internal structure wholly covered with and bonded to the inner and outer skin layers, the internal structure comprising a plurality of core elements, the composite sandwich structure comprising a unitary matrix for bonding the internal structure, the inner skin layer and outer skin layer, parts of the outer skin layer being directly exposed to the outside, parts of the inner skin layer being directly used as inner wall for the driver's cabin, the driver's cabin structure comprising at least:

side pillars each having a lower end and an upper end, comprising a fibre-reinforced sandwich, and a reactor structure located towards, and integrated with, the lower end of each of the side pillars, the reactor structure being reinforced such as to transfer static and crash loads to the main body structure of the rail vehicle and including a central cavity open towards the front end of the driver's cabin to accommodate a coupling element for the rail vehicle.

2. The integrated self-supporting and deformation-resistant driver's cabin structure of claim 1, wherein the internal structure consists of a sandwich construction produced from glass fibre-reinforced polymer (GFRP) composite layers and core elements made of polymer or aluminium foam, balsa or other lightweight wood or any kind of honeycomb core material, including aluminium honeycomb, aramid paper-based honeycomb, other paper-based honeycomb, or polymer-based honeycomb.

3. The integrated self-supporting and deformation-resistant driver's cabin structure of claim 2, wherein the sandwich structure is significantly reinforced in the side pillars and reactor in order to provide sufficient stiffness and strength for resisting energy absorber collapse forces without permanent deformation or damage.

4. The integrated self-supporting and deformation-resistant driver's cabin structure of claim 3, wherein the internal structure in the side pillars includes vertical columns of foam sandwiched between continuous vertical layers of GFRP to produce a multi-layer sandwich construction.

5. The integrated self-supporting and deformation-resistant driver's cabin structure of claim 3, wherein the internal structure in the side pillars is reinforced to provide a high bending stiffness to the side pillars.

6. The integrated self-supporting and deformation-resistant driver's cabin structure of claim 3, wherein the reactor structure consists of an array of bonded foam cores wrapped in glass fibre reinforced polymer (GFRP) to produce a macro-cellular structure.

7. The integrated self-supporting and deformation-resistant driver's cabin structure of claim 3, wherein the reactor structure is reinforced so as such as to transfer static and crash loads to the main body structure of the rail vehicle without flexural buckling.

8. The integrated self-supporting and deformation-resistant driver's cabin structure of claim 1, further comprising reinforcing roof beams located towards the upper end of each of the side pillars, the composite sandwich construction comprising an orientated fibre lay-up in the roof beams providing an anisotropic strength with higher strength in a longitudinal direction of the roof beams or providing an isotropic strength performance.

9. The integrated self-supporting and deformation-resistant driver's cabin structure of claim 1, further providing a side door and/or side window opening.

10. A modular front end structure for a rail vehicle, including:

the integrated self-supporting and deformation-resistant driver's cabin structure of claim 1, a distributed upper energy absorber means consisting of a crossbeam extending continuously from one of the side pillars to the other.

11. The modular front end structure of claim 10, wherein the upper energy absorber means comprises a collapsible structure extending from one of the side pillars to the other such as to provide an energy absorption capability.

12. The modular front end structure of claim 10, wherein the upper energy absorber means is formed as a multi-layer aluminium honeycomb sandwich.

13. The modular front end structure of claim 12, wherein the buffer-level energy absorber means include individual second energy absorber elements located on each side of the modular front end structure at the height of the reactor structure.

14. The modular front end structure of claim 13, wherein the individual second energy absorber elements are replaceable.

15. The modular front end structure of claim 10, wherein the upper energy absorber means is such as to provide lateral rigidity and enhanced missile protection coverage for the driver.

16. The modular front end structure of claim 10, wherein the crossbeam is removably attached to the integrated self-supporting and deformation-resistant driver's cabin structure.

17. The modular front end structure of claim 10, further comprising lower, buffer-level energy absorber means.

18. A process for manufacturing the integrated self-supporting and deformation-resistant driver's cabin structure of claim 1, wherein a unitary matrix material is introduced to skin layer reinforcement fibres and to core materials before or after the reinforcement fibres are placed into a mould cavity or onto a mould surface of a mould and the matrix material subsequently experiences a polymerisation or curing event to constitute the sandwich composite structure.

19. The process of claim 18, wherein the fibres of the inner skin layer and/or outer skin layer and the core materials are placed in the mould cavity or on the mould surface before the unitary matrix material is introduced.

20. An integrated self-supporting and deformation-resistant modular driver's cabin structure for mounting to the front end of a rail vehicle body, the driver's cabin structure having a front end and a longitudinal direction, the driver's cabin structure providing a driver space and a windshield opening, the driver's cabin structure including two side parts, each side part consisting of a composite sandwich structure with a single, common, continuous outer skin layer, a single, common, continuous inner skin layer and an internal structure covered with and bonded to the inner and outer skin layers, the internal structure comprising a plurality of core elements, the composite sandwich structure comprising a unitary matrix for bonding the internal structure, the inner skin layer and outer skin layer, parts of the outer skin layer being directly exposed to the outside, parts of the inner skin layer being directly used as inner wall for the driver's cabin, each side part comprising at least: one side pillar having a lower end and an upper end, comprising a fibre-reinforced sandwich, and a reactor element extending from the lower end of each of the side pillar in the longitudinal direction towards the rear end of the driver's cabin structure, the reactor element being reinforced such as to transfer static and crash loads to the main body structure of the rail vehicle, the driver's cabin structure being provided with a central cavity between the reactor elements of the two side parts, the central cavity being open towards the front end of the driver's cabin to accommodate a coupling element for the rail vehicle.

21. The integrated self-supporting and deformation-resistant modular driver's cabin structure of claim 20, wherein the fibre-reinforced sandwich at the side pillars is reinforced such as to provide a high bending stiffness.

22. The integrated self-supporting and deformation-resistant modular driver's cabin structure of claim 20, wherein the reactor elements are reinforced so as to transfer static and crash loads to the main body structure of the rail vehicle without flexural buckling.

23. The integrated self-supporting and deformation-resistant modular driver's cabin structure of claim 20, wherein each side part forms an integral monocoque structure, the internal structure of which is wholly covered by the outer and inner skin layers.

24. The integrated self-supporting and deformation-resistant modular driver's cabin structure of claim 20, wherein the internal structure in the side pillar and in the reactor element comprises a plurality of core elements.

25. The integrated self-supporting and deformation-resistant modular driver's cabin structure of claim 24, wherein each core element is covered by a composite material.

26. The integrated self-supporting and deformation-resistant modular driver's cabin structure of claim 20, wherein each side part further includes a roof beam extending in the longitudinal direction from the upper end of the side pillar towards the rear end of the driver's cabin structure.

* * * * *